United States Patent [19]

Choe

[11] 4,256,933

[45] Mar. 17, 1981

[54] SWITCHING DEVICE FOR PREVENTING PROLONGED ELECTRICAL CONTACT

[75] Inventor: Pil Y. Choe, Dunellen, N.J.

[73] Assignee: Man Bo Inc., Dunellen, N.J.

[21] Appl. No.: 64,543

[22] Filed: Aug. 8, 1979

[51] Int. Cl.[3] ..... H01H 7/03

[52] U.S. Cl. ..... 200/34; 200/82 R; 200/160; 267/114

[58] Field of Search ..... 200/33 R, 34, 83 T, 200/160, 159 R, 82 R, 83 R, 83 S, 83 J; 267/114

[56] References Cited

U.S. PATENT DOCUMENTS 3,843,855 10/1974 Danielson ..... 200/34

*Primary Examiner*—J. V. Truhe
*Assistant Examiner*—Morris Ginsburg
*Attorney, Agent, or Firm*—Richard J. Rodrick

[57] ABSTRACT

A switching device for preventing prolonged depression-action type activation includes a housing and a depressible plunger mounted in the housing. This plunger includes an upper portion and a lower portion, with the lower portion being movable with respect to the upper portion. The plunger is adapted to be filled with fluid and has a fluid inlet port and a fluid outlet port. An operable stopper valve is associated with the outlet port for maintaining it closed, with the valve being operatively responsive to depression of the plunger for allowing fluid to escape from the plunger. A first spring associated with the lower portion retracts the same inwardly toward the housing when sufficient fluid has escaped from the plunger and while the upper portion is depressed inwardly. A second spring associated with the upper portion urges the same outwardly from the housing when there is no depression force on the upper portion. Fluid is then permitted to re-enter the plunger through the inlet port when the stopper valve closes the outlet port upon removal of the depression force from the upper portion.

12 Claims, 5 Drawing Figures

SWITCHING DEVICE FOR PREVENTING PROLONGED ELECTRICAL CONTACT

BACKGROUND OF THE INVENTION

The present invention relates to a device for preventing prolonged depression-action type activation in a contact mechanism, and more particularly, concerns a push-button switching device which permits electrical contact to be broken even while an operator of the device holds the push-button down so that the switch is in the normally closed position.

Various types of switches and contact mechanisms operable by depression-action activation are employed particularly for heavy duty, industrial-type situations for making an electrical connection to a power source. Panel mounted, wall mounted, or switch box push-button type switches are most prevalent for these switching type needs. One type of push-button switch is the momentary type wherein electrical contact is established by depressing the button inwardly; as long as the operator holds the button down, electrical contact is maintained. As soon as the button is released, electrical contact is broken and the switch is open, thereby de-energizing the system. Such a momentary switch thus requires the operator's attention to assure that electrical contact is made only for the necessary periods of time. Another type of push-button switch is one which maintains contact. This type of switch includes a button which remains depressed upon the initial downward movement to close the switch; to open the switch and break electrical contact, the operator must depress the button inward slightly in order to release the spring mechanism and thereby return the button to the original starting position. Each of these previously described switches serves the needs for specific switching applications effectively, but, on the other hand, have a number of deficiencies.

For instance, when using the momentary switch for establishing an electrical connection, the system is generally wired so that only a brief depression of the button is necessary to close the switch and energize the system. This brief period of time may be as short as one second; thus, the operator to activate the system merely depresses the button quickly, then releases same in order to establish electrical contact. The initial depression generally signals the switch to close and may include one or more electrical relays or the like in order to maintain the electrical contact upon the initial, brief depression of the button. When electrical contact is to be broken, another brief depression of the button opens the switch by means of appropriate circuitry including relays and the like. It can then be appreciated that, with the switching circuitry involved, prolonged depression of this type of push-button switch may induce problems. Specifically, if the operator seeks to assure that electrical contact is established and holds the button downwardly too long, it is conceivable that a sensitive electrical system may be overloaded, with some type of power failure in the system then being induced. In other words, with those type of push-button switches which are meant to establish electrical contact with only a brief, firm depression of the button, problems may arise when the button is held down unnecessarily lengthy periods of time. This is indeed a problem inasmuch as the operator may not even be aware that holding this type of push-button switch down too long could cause a problem; thus, the operator oftentimes attempts to push the button down for a sufficiently long period of time to assure electrical contact without really knowing that he may be inducing some damage or failure.

An anti-holddown switch actuating mechanism which will open after a predetermined time after actuation, regardless of whether the operator maintains pressure on an operating knob, has been described in U.S. Pat. No. 3,843,855, issued to Danielson. In the Danielson disclosure, an operating knob, upon being downwardly depressed, causes the air pressure in a cylindrical bore to increase, which inturn distends a diaphragm downwardly. A contact button on the bottom of the diaphragm also moves downwardly, depressing a plunger to close the switch. The increase in air is bled off through a small orifice. Regulation of bleeding is controlled by a tapered portion of an adjustment screw. Air is allowed to re-enter the piston through a one-way fluid diode. While the Danielson patent indeed discloses one type of anti-holddown device, some problems are inherent in the structure and configuration proposed by Danielson. For instance, inasmuch as air starts to bleed as soon as the knob is pushed, if the operator pushes slowly (virtually at the same speed as the air bleed-off rate) the device will not function properly. Also, the strength of Danielson's diaphragm also contributes to the functionability of his device. Specifically, if the diaphragm is flimsy or weak, the spring force in the contact block would not be overcome, so that the plunger in the bottom block would never be depressed sufficient to close the switch. On the other hand, if the spring in the bottom contact block of Danielson is too weak, it will not be strong enough to push the diaphragm completely back to its initial starting position, thereby impairing its functionability. Furthermore, the working of Danielson's anti-holddown actuating mechanism relies upon the spring element in the regular bottom contact block, which is found in many standard industrial type switches. Thus, the adaptability of Danielson's device is limited to those instances where a spring loaded plunger is provided to return the contact button on the diaphragm back to its starting position. Thus, it can be seen that further improvements in this type of device are still being sought, and it is to this end that the present invention is directed.

SUMMARY OF THE INVENTION

A device for preventing prolonged depression-action type activation includes a housing and depressible plunger means mounted in the housing. The plunger means has an upper and a lower portion, with the lower portion being movable with respect to the upper portion. This plunger means is adapted to be filled with fluid and has fluid inlet and fluid outlet means. Operable stopper means is associated with the outlet means for normally maintaining the same closed, and being operatively responsive to depression of the plunger means for allowing fluid to escape therefrom. First spring means is associated with the lower portion of the plunger for retracting the same inwardly toward the housing when sufficient fluid has escaped from the plunger means while the upper portion of the plunger is depressed inwardly into the housing. Second spring means is associated with the upper portion of the plunger for urging the same outwardly from the housing when no depression force is appied to the upper portion. Fluid is then permitted to re-enter the plunger means through the fluid inlet means when the stopper means closes the outlet means upon removal of the depression force from the upper portion of the plunger.

It is understood that reference herein to a depression-action type activation mechanism includes many devices operable by reliance on the depression principle. Included are push-button electrical contact switches, such as the momentary type, limit switches which are usually lever operated, electrical relays which rely upon an extensible piston or rod for operating the contact element, flexible diaphragms which provide sufficient displacement to activate a contact switch due to pressure exerted thereon, and other devices of similar character and related principles of operation.

In the preferred embodiment of the present invention, the device as substantially described above is a switching device and includes an upper assembly including spring-loaded button means depressible downwardly, and a lower assembly including spring-loaded switch contact means depressible downwardly to close a switch, with means thereon for making an electrical connection to the switch. The housing is interposed between the upper and the lower assembly, so that the upper portion of the plunger is adapted to be contacted by the downward movement of the button means. Also, the lower portion of the plunger means is adapted to contact the switch contact means in the lower assembly upon downward depression of the plunger means. This switching device therefore permits the lower portion of the plunger means to retract inwardly toward the housing when sufficient fluid has escaped from the plunger means while the button means is depressed downwardly against the upper portion of the plunger.

From the structural standpoint, the contact preventing device of the present invention is notably different from other devices in this category, including the anti-holddown device as mentioned above in conjunction with the Danielson patent. For instance, the dual plunger element of the present invention, with the lower portion being movable with respect to the upper portion, contributes significantly to the functionability of this invention. The downward movement of the plunger means and its spring elements for retracting, particularly the lower portion of the plunger means back into the housing is self-contained and therefore does not rely upon spring action from a standard contact block to which this device may be attached. As a result, the reliability of this type of switching device to prevent prolonged electrical contact is improved. If an operator of this preferred switching device holds the button down too long, the lower portion of the plunger means is designed to retract inwardly toward the housing whereby electrical contact is broken, even while the button is still depressed. It can be seen that the device of the present invention offers the advantage of eliminating any damage which may ensue in those instances where prolonged depression of the push-button would normally have induced such problems. Furthermore, inasmuch as the device of the present invention is self-contained, it is more adaptable to other type of switching or related push-button circumstances, whereas the device of the Danielson patent, for instance, relies upon the spring element in the contact block to assure its functionability. Other advantages of the present invention are offered as well, as will become more evident upon reading the detailed description hereinafter.

DETAILED DESCRIPTION

Figure 1:
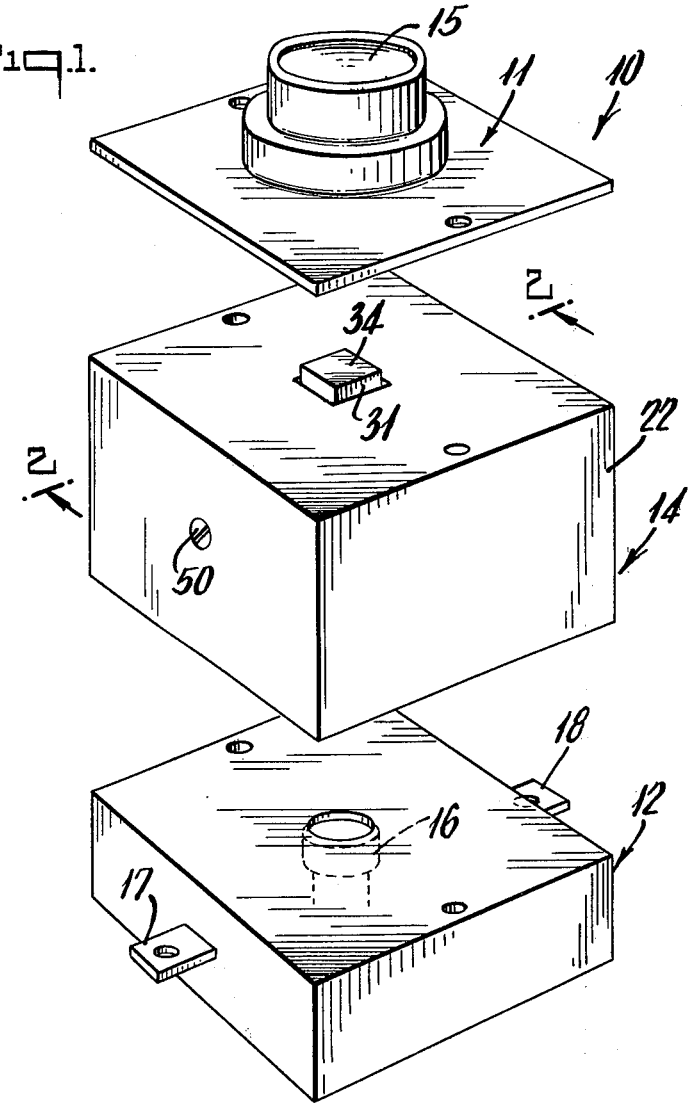
FIG. 1 is an exploded perspective view illustrating the preferred push-button type switching device of the present invention for preventing prolonged electrical contact.

While this invention is satisfied by embodiments in many different forms there is shown in the drawings and will herein be described in detail a preferred embodiment of the invention, with the understanding that the present disclosure is to be considered an exemplary of the principles of the invention and is not intended to limit the invention to the embodiment illustrated. The scope of the invention will be pointed out in the appended claims.

Adverting to the drawings, particularly to FIG. 1, there is illustrated in exploded view a preferred push-button type switching assembly 10. This switching assembly contains three general components: an upper assembly 11, a lower assembly 12 and a device for preventing prolonged depression-action type activation and contact 14. Both upper assembly 11 and lower assembly 12 are standard items in a push-button switching mechanism, and may be purchased readily from a number of manufacturers. Upper assembly 11 includes a spring loaded button 15 which is depressible downwardly. Lower assembly 12 includes a spring loaded switch contact 16, also depressible downwardly to close a switch inside assembly 12. Electrical connection pins 17 and 18 are provided for making a connection to the switch inside. Contact prevention device 14, however, is not a standard item, but provides the unique features of being adaptable to a switching assembly for preventing prolonged electrical contact, particularly in the push-button type switch.

Figure 2:
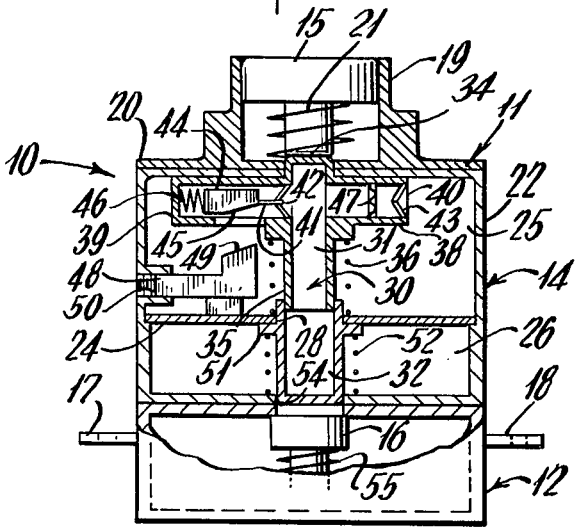
FIG. 2 is a cross-sectional view taken along line 2—2 of FIG. 1 with the components illustrated as assembled and with the push-button in the initial starting position.

Turning now to FIG. 2, taken in conjunction with FIG. 1, the internal elements, particularly of contact prevention device 14, are more clearly illustrated. In FIG. 2 the components of switching assembly 10 are shown assembled, with contact prevention device 14 interposed between upper assembly 11 and lower assembly 12. Suitable screw fasteners or the like are utilized to secure the components together. Upper assembly 11 includes a substantially cylindrical collar 19 mounted on a plate 20. Depressible button 15 is slidably positioned inside collar 19 with a helical spring 21 provided to bias button 15 upwardly so that after being depressed it returns to the initial starting position.

Contact prevention device 14 includes a box-shaped housing 22 which serves as a container for the internal components of this device. A platform 24 is mounted inside and laterally across housing 22 to divide the interior of the housing into an upper compartment 25 and a lower compartment 26. An opening 28, preferably round, is provided through platform 24, and is located substantially centrally within housing 22. Positioned within housing 22, and held by suitable bracketry, (not shown) is a depressible plunger 30, having an upper portion 31 and a lower portion 32, with lower portion 32 being movable, and preferably slideable, with respect to upper portion 31. Both the upper and lower portions of the plunger are hollow and thus adapted to be filled with air or other fluid within.

Referring more particularly to upper portion 31 of the plunger, it includes an engagement face 34 at its top which is to be contacted by the downward movement of button 15. The bottom section 35 is preferably cylindrically shaped in order to facilitate the sliding movement with respect to lower portion 32. Surrounding bottom section 35 is a helical spring 36 which biases upper portion 31 in an outward direction from the housing or upwardly, depending upon orientation. Extending laterally from each side of upper portion 31 are two substantially cylindrical, hollow extensions 38 and 39. The end of extention 38 is open and serves as an air inlet port 40; however, a slitted elastomeric membrane 43 is included in the air inlet port 40 which serves as a one-way flow valve to allow air to enter only inwardly inside the plunger. A filter medium 47 is preferably positioned inside lateral extention 38 to filter the air as it enters into the plunger.

Figure 5:
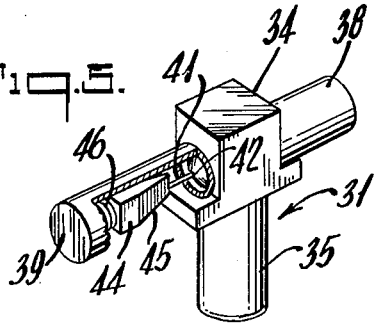
FIG. 5 is an enlarged prospective view shown partially broken away of the preferred upper portion of the plunger together with the operable needle valve for closing the plunger outlet port.

On the other hand, lateral extension 39 serves as a bracket for holding a spring-loaded needle valve 41 which is positioned to be inserted into an opening 42 in the plunger which serves as an air outlet port. These elements are more clearly illustrated in the enlarged view of the upper portion of the plunger in FIG. 5. The rear portion of needle valve 41 includes a sliding block 44, which is wedge-shaped to include an inclined surface 45 facing toward the plunger. A helical spring 46 biases needle valve 41 inwardly into air outlet port 42 so that the same is normally maintained closed.

Returning again to FIG. 2, mounted on platform 24 and oriented below lateral extension 39 is an engagement block 48. An inclined surface 49 is included on engagement block 48 and mates with inclined surface 45 associated with the needle valve. The function of these mating inclined surfaces will be explained hereinafter. Engagement block 48 is laterally adjustable along platform 24, with a suitable screw mechanism 50 provided through housing 22 in order to allow the operator to make such an adjustment.

Positioned in lower compartment 26 on the bottom side of platform 24 is the lower portion of plunger 30. Lower portion 32 is a cup-shaped member, substantially cylindrically shaped and sized to slidably fit over bottom section 35 of the upper portion of the plunger. These cylindrical sections of the upper and lower portions form a substantially air-tight plunger assembly so that air can only enter into the plunger through air inlet port 40 and exit from the plunger through air outlet port 42. Lower portion 32 includes a flange 51 which abuts against platform 24 for maintaining lower portion in lower compartment 26. A helical spring 52 presses against flange 51 and serves to bias lower portion 32 normally inwardly toward the housing, or upwardly, depending upon orientation. A hole 54 is included in the bottom of housing 22 in order to allow the lower portion of the plunger to extend downwardly, out of the housing. As can be seen in the drawings, the bottom face of lower portion 32 is adapted to contact switch contact 16 in the lower assembly upon downward depression of the plunger. Lower assembly 12 also includes a spring 55 associated with switch contact 16 to normally bias the same upwardly. As thus seen in FIG. 2, when button 15 is in the un-depressed condition, upper portion 31 of the plunger protrudes upwardly from the housing and lower portion 32 is substantially within the confines of the housing.

Figure 3:
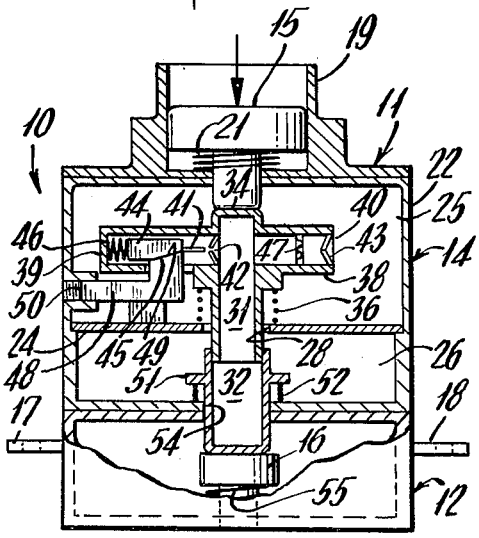
FIG. 3 is a cross-sectional view similar to that of FIG. 2 illustrating the position of the elements of the device immediately subsequent to depression of the push-button.
Figure 4:
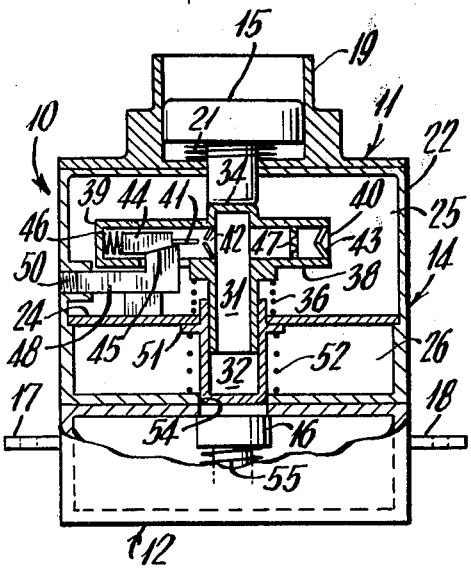
FIG. 4 is a cross-sectional view similar to that of FIGS. 2 and 3 illustrating the position of the elements of the device when prolonged depression of the push-button occurs.

Referring now to FIG. 3, a depression force, such as exerted by the finger of an operator, depresses button 15 downwardly, engaging face 34 of the plunger thereby also depressing the plunger downwardly. Before sliding block 44 contacts engagement block 48, needle valve 41 is still inserted into air outlet port 42 effectively keeping same closed. Thus, the airtight plunger maintains its original length, with no sliding movement between its upper and lower portions. Thus, the entire plunger assembly moves downwardly so that the upper portion is substantially within the confines of the housing and the lower portion protrudes downwardly out of hole 54 until it engages switch contact 16 in lower assembly 12. This then effectively closes the switch in the lower assembly so that the proper electrical energizing condition can be realized. It is appreciated that only momentary energizing is required in most electrical systems for proper functioning. Therefore, the present invention takes cognizance of this fact and provides the wherewithal for preventing prolonged push-button electrical contact which may cause damage to sensitive electrical components in the system. This preventative measure is achieved, as can be seen by referring to FIG. 3, by permitting the air inside the plunger to bleed off so that the lower portion of the plunger can retract inwardly toward the housing. This procedure is started when, following depression of button 15 and plunger 30, sliding block 44 contacts engagement block 48. The mating inclined surfaces of these blocks causes rectilinear, outward movement of needle valve 41 inasmuch as engagement block 48 is fixed and needle valve 41 and sliding block are constructed to allow this movement. Thus, this contact causes needle valve 41 to disengage from air outlet port 42, consequently allowing air to escape from the cylinders forming the plunger. Depending upon the adjustable position of engagement block 48, the mating inclined surfaces will contact in different locations so that the needle valve position can control the rate of air flow from the plunger. Once air outlet port 42 is open, a balancing factor between air pressure inside the plunger and the strength of helical spring 52 surrounding lower portion 32 comes into effect. When sufficient air has escaped from the plunger while the upper portion is depressed inwardly into the housing so that the force of spring 52 is greater than the internal air pressure of the plunger, spring 52 will then push against flange 51 and retract lower portion 32 inwardly into the housing. This inward movement is provided by the sliding of lower portion 32 over upper portion 31 to thereby compress the overall length of the plunger which is still being depressed by the depression force against button 15. This occurrence is more clearly illustrated in FIG. 4.

Note that sliding block 44 and engagement block 48 are still in contact so that needle valve 41 is disengaged from outlet port 42 of the plunger. This open air outlet port allows the compression of the length of the plunger which occurs when lower portion 32 is retracted all the way upward so that flange 51 abuts against platform 24 inside the housing. When this happens, depression of switch contact 16 in the lower assembly is released, thereby assuring that it is not held down for excessively long periods of time which may damage sensitive electrical components. It is appreciated that the contact prevention device of the present invention can be designed so that lower portion 32 of the plunger can be retracted inwardly either quickly, such as within one second after depression of the button, or more slowly depending upon the adjustment of engagement block 48 and its contact with the needle valve structure. It should also be mentioned that spring 52 causes retraction of lower portion 32, without dependence upon the spring 55 in lower assembly 12, which other similar type devices have relied upon for functionability of this type device. Therefore, it can be seen, especially in FIG. 4, that even while button 15 is being depressed downwardly, there is no prolonged electrical contact made against switch contact 16 after the original, momentary contact has been established. Plunger 30 will stay in its compressed position until the depression force is released from button 15.

When this occurs, spring 21 associated with button 15 urges the button back to its initial starting position, and helical spring 36 does likewise, by urging upper portion 31 outwardly from said housing (or upwardly, depending upon orientation), with the internal elements taking on the configuration as seen in FIG. 2. As soon as upper portion 31 is urged upwardly to spring 36, sliding block 44 disengages from engagement block 48 with spring-loaded needle valve 41 once again closing air outlet port 42. As this happens, the volume inside the plunger increases since the upper portion moves outwardly with respect to the lower portion of the plunger. This causes air to enter inlet port 40 through one-way flow valve 43, and through filter 47 and thus inside plunger 30. Air enters into the plunger until the pressure inside is in substantial equilibrium with the pressure outside the plunger. Needle valve 41 serves as an effective stopper device to prevent escape of air at the same time air is entering into the plunger through air inlet support 40. This all takes place quickly and places the switching device in readiness for the next operation in a minimal amount of time.

Thus, the present invention provides a device, particularly useful in depression-action type switching assemblies, which prevents prolonged electrical contact when the push-button or similar mechanism is depressed. As a result, the device of the present invention eliminates that kind of damage which normally would have occurred to the electrical components in the system except for the utilization of this present device.

What is claimed is:

1. A device for preventing prolonged depression-action type activation comprising: a housing; a depressible plunger mounted in said housing having an upper portion and a lower portion, said lower portion being movable with respect to said upper portion, said plunger adapted to be filled with air and having an air inlet port and an air outlet port; means including operable stopper means associated with said outlet port for normally maintaining same closed and being operatively responsive to depression of the upper portion of said plunger for allowing air to escape from said plunger; first spring means associated with said lower portion for retracting same inwardly toward said housing when sufficient air has escaped from said plunger while said upper portion is depressed inwardly into said housing; and second spring means associated with said upper portion for urging said upper portion outwardly from said housing when no depression force is applied to said upper portion, with air being permitted to re-enter said plunger through said air inlet port when said stopper means closes said outlet port upon removal of the depression force from said upper portion.

2. The device of claim 1 wherein said plunger is mounted in said housing so that in the un-depressed condition said upper portion protrudes upwardly from said housing and said lower portion is substantially within the confines of said housing, and in the depressed condition said upper portion is substantially within the confines of said housing and said lower portion protrudes downwardly from said housing until the air inside said plunger escapes sufficiently to allow said lower portion to retract inside said housing.

3. The device of claim 2 wherein said upper portion and said lower portion of said plunger include hollow cylinders forming substantially an air tight plunger with one of said cylinders being slidable over the other of said cylinders to compress the length of said plunger.

4. The device of claim 1 wherein said means further includes engagement means mounted in said housing in position to be engaged by said stopper means upon depression of said plunger, said engagement means adapted to operatively cause said stopper means to disengage from said outlet port and allow air to escape from said plunger.

5. The device of claim 4 wherein said engagement means is an engagement block which is adjustable to contact said operable stopper means in different locations so that the rate of air flow from said plunger can be varied.

6. The device of claim 5 wherein said engagement block and said stopper means include mating inclined surfaces to facilitate the operability of said stopper means.

7. The device of claim 1 wherein said operable stopper means includes a spring-loaded needle valve which is inserted in said outlet port when said plunger is in the un-depressed condition.

8. The device of claim 1 wherein said air inlet port includes a one-way flow valve to allow air to enter only inwardly inside said plunger.

9. The device of claim 8 wherein said air inlet port includes the filter medium to filter the air as it enters into said plunger.

10. A device for preventing prolonged depression-action type activation comprising: a housing; depressible plunger means mounted in said housing having an upper portion and a lower portion, said lower portion being movable with respect to said upper portion, said plunger means adapted to be filled with fluid and having fluid inlet means and fluid outlet means; operable stopper means associated with said outlet means for normally maintaining same closed and being operatively responsive to depression of said plunger means for allowing fluid to escape from said plunger means; means associated with said lower portion for retracting same inwardly toward said housing when sufficient fluid has escaped from said plunger means while said upper portion is depressed inwardly into said housing; and means associated with said upper portion for urging same outwardly from said housing when no depression force is applied to said upper portion, fluid being permitted to re-enter said plunger means through said fluid inlet means when said stopper means closes said outlet means upon removal of the depression force from said upper portion.

11. A device for preventing prolonged depression-action type activation comprising: a housing; a depressible plunger mounted in said housing having an upper hollow cylinder and a lower hollow cylinder, both cylinders adapted to be filled with air, said upper cylinder having an air inlet port with one-way flow valve to allow air to enter only inwardly, said upper cylinder having an air outlet port, said cylinders forming a substantially air-tight plunger with one of said cylinders being slidable over the other of said cylinders to compress the length of said plunger, said cylinders being so mounted in said housing so that in the un-depressed condition said upper cylinder protrudes upwardly from said housing and said lower cylinder is substantially within the confines of said housing, and in the depressed condition said upper cylinder is substantially within the confines of said housing and said lower cylinder protrudes downwardly from said housing; a spring-loaded needle valve connected to said upper cylinder inserted in said outlet port when said plunger is in the un-depressed condition for normally maintaining said outlet port closed; an engagement block mounted in said housing in position to be engaged by a portion of said needle valve upon depression of said plunger to cause said needle valve to disengage from said outlet port and allow air to escape from said cylinders, said engagement block being adjustable so that its contact with a portion of said needle valve can control the air flow rate from said cylinders, said engagement block and said contact portion of said needle valve having mating inclined surfaces to facilitate the operability of said needle valve; a first spring associated with said lower cylinder for retracting said inwardly into said housing when sufficient air has escaped from said cylinders while the upper cylinder is depressed inwardly into said housing; and a second spring associated with said upper cylinder for urging same outwardly from said housing when no depression force is applied to said upper cylinder, with air being permitted to re-enter said cylinders through said air inlet port when said needle valve closes said air outlet port upon removal of the depression force from said upper cylinder.

12. A push-button type switching device for preventing prolonged electrical contact comprising: an upper assembly including spring-loaded button means depressible downwardly; a lower assembly including spring-loaded switch contact means depressible downwardly to close a switch, and having means therewith for making a electrical connection to said switch; a housing interposed between said upper and said lower assemblies; depressible plunger means mounted in said housing having an upper portion and a lower portion, said upper portion adapted to be contacted by the downward movement of said button means, said lower portion being movable with respect to said upper portion and adapted to contact said switch contact means upon downward depression of said plunger means, said plunger means adapted to be filled with fluid and having fluid inlet means and filled outlet means; operable stopper means associated with said outlet means for normally maintaining same closed and being operatively responsive to depression of said plunger means for allowing fluid to escape from said plunger means; means associated with said lower portion for retracting same inwardly toward said housing when sufficient fluid has escaped from said plunger means while said button means is depressed downwardly against said upper portion; and means associated with said upper portion for urging same outwardly from said housing when said button means is not depressed, with fluid being permitted to re-enter said plunger means through said inlet means when said stopper means closes said outlet means upon removal of the downward depression of said button means.

* * * * *